US007780428B2

(12) United States Patent
Zhao et al.

(10) Patent No.: US 7,780,428 B2
(45) Date of Patent: Aug. 24, 2010

(54) FLUID-GUIDING AND ELECTRIC CONDUCTING SYSTEM FOR SUSPENDED ELECTRIC SUBMERSIBLE PROGRESSING CAVITY PUMP (PCP)

(76) Inventors: Xihuan Zhao, No. 7-4-403, Jinguming Garden, Taierzhuang Road, Hexi District, Tianjin (CN) 300202; Ruiqi Zhang, No. 2-3-1702, Fubang Garden, Xiamen Road, Hexi District, Tianjin (CN) 300203

( * ) Notice: Subject to any disclaimer, the term of this patent is extended or adjusted under 35 U.S.C. 154(b) by 221 days.

(21) Appl. No.: 12/171,360

(22) Filed: Jul. 11, 2008

(65) Prior Publication Data

US 2008/0267802 A1 Oct. 30, 2008

Related U.S. Application Data

(63) Continuation of application No. PCT/CN2006/000411, filed on Mar. 17, 2006.

(30) Foreign Application Priority Data

Mar. 14, 2006 (CN) ..... 2006 1 0013297

(51) Int. Cl.
*F01C 1/10* (2006.01)
*F01C 5/00* (2006.01)
*F03C 2/00* (2006.01)
*F04C 2/00* (2006.01)

(52) U.S. Cl. ..... 418/48; 166/66.4; 166/106; 417/417; 417/423.3

(58) Field of Classification Search ..... 418/48; 417/410.1, 417, 423.3; 166/66.4, 106
See application file for complete search history.

(56) References Cited

U.S. PATENT DOCUMENTS

| | | | | | |
|---|---|---|---|---|---|
| 2,297,020 | A | * | 9/1942 | Page | 166/66.4 |
| 3,677,665 | A | * | 7/1972 | Corkill | 417/410.3 |
| 5,070,940 | A | * | 12/1991 | Conner et al. | 166/66.4 |
| 5,620,048 | A | * | 4/1997 | Beauquin | 166/106 |
| 6,047,784 | A | * | 4/2000 | Dorel | 175/61 |
| 6,260,626 | B1 | * | 7/2001 | Rivas | 166/369 |
| RE37,995 | E | * | 2/2003 | Barrus et al. | 417/410.3 |
| 6,595,295 | B1 | * | 7/2003 | Berry et al. | 166/106 |

FOREIGN PATENT DOCUMENTS

| | | | |
|---|---|---|---|
| CN | 2343382 | Y | * 10/1999 |
| CN | 2399530 | Y | * 10/2000 |
| CN | 2661917 | Y | * 12/2004 |

* cited by examiner

*Primary Examiner*—Theresa Trieu
(74) *Attorney, Agent, or Firm*—Matthias Scholl P.C.; Matthias Scholl

(57) ABSTRACT

A fluid-guiding and electric conducting system for a suspended electric submersible PCP comprises a fluid-guiding system and an electric conducting system. The fluid-guiding system comprises an upper connector, a protector, a fluid-guiding sleeve, a driving mechanism, a shaft coupling, a first annular cavity, a second annular cavity, a third annular cavity, a fourth annular cavity, and a fluid outlet. The first annular cavity, the second annular cavity, the third annular cavity, the fourth annular cavity, and the fluid outlet are connected orderly to the well fluid pipe. The electric conducting system comprises a motor lead wire, a center hole of the protector, a fifth annular cavity, and a wire outlet. The fluid-guiding and electric conducting system has the advantages of simple structure, low manufacturing cost, easy assembly and inexpensive maintenance.

7 Claims, 3 Drawing Sheets

FLUID-GUIDING AND ELECTRIC CONDUCTING SYSTEM FOR SUSPENDED ELECTRIC SUBMERSIBLE PROGRESSING CAVITY PUMP (PCP)

CROSS-REFERENCE TO RELATED APPLICATIONS

This application is a continuation of International Patent Application No. PCT/CN2006/000411 with an international filing date of Mar. 17, 2006, designating the United States, now pending, and further claims priority benefits to Chinese Patent Application No. 200610013297.0 filed Mar. 14, 2006. The contents of all of the aforementioned applications, including any intervening amendments thereto, are incorporated herein by reference.

BACKGROUND OF THE INVENTION

1. Field of the Invention

The invention relates to electric submersible progressing cavity pump (PCP), and more particularly, to a fluid-guiding and electric conducting system for a suspended electric submersible progressing cavity pump (PCP).

2. Description of the Related Art

Currently, ground driven PCP are widely used for extracting thick well fluid. However, ground driven PCP have many drawbacks. First, when a thin drive shaft of a ground driven PCP rotates inside of the well fluid pipe, large friction is generated between the drive shaft and the inner wall of the well fluid pipe. Large friction means that the PCP can only be operated at low rotational speeds, and thus their function cannot be utilized effectively. Secondly, even higher friction losses between the drive shaft and the inner wall of the well fluid pipe occur when the pumped well fluid has a high sand content, when the pipe slope is steep, when the suspended position of the pump is low, or when the pipe has many inflexion points. Under these circumstances, the drive shaft may be deformed or broken, the well fluid pipe may be worn out, and the PCP may fail to operate.

In order to solve the above problems, a suspended type electric submersible PCP has been developed. The driving mechanism of the suspended electric submersible PCP has an elongated structure, can be submerged into a well along the pipe, and the long drive shaft is replaced with a short flexible shaft, so that the drawbacks of above mentioned ground driven PCP are overcome. However, since the driving mechanism of a conventional suspended type electric submersible PCP is located between the well fluid pipe and the PCP, and the space inside the pipe is limited, passing the pumped well fluid through the driving mechanism into the well fluid pipe and connecting reliably the lead wire of the motor to the power supply presents a problem.

SUMMARY OF THE INVENTION

Therefore, it is one objective of the invention to provide a fluid-guiding and electric conducting system for a suspended electric submersible PCP to overcome the drawbacks associated with conventional ground driven PCP and suspended electric submersible PCP.

In order to realize the above objective, provided is a fluid-guiding and electric conducting system for a suspended electric submersible PCP comprising a fluid-guiding system and an electric conducting system, wherein the fluid-guiding system comprises an upper connector having a core portion, a protector having an outer circumferential surface, a fluid-guiding sleeve having an inner circumferential surface, a driving mechanism having an outer circumferential surface, a shaft coupling, a first annular cavity, a second annular cavity, a third annular cavity, a fourth annular cavity, and a fluid outlet; the shaft coupling comprises a bearing shell having an outer circumferential surface, an outer sleeve having an inner circumferential surface, and a flexible shaft having an outer circumferential surface; the first annular cavity is formed between the outer circumferential surface of the bearing shell of the shaft coupling and the inner circumferential surface of the outer sleeve of the shaft coupling; the second annular cavity is formed between the inner circumferential surface of the outer sleeve of the shaft coupling and the outer circumferential surface of the flexible shaft; the third annular cavity is formed between the inner circumferential surface of the fluid-guiding sleeve and the outer circumferential surface of the driving mechanism; the fourth annular cavity is formed between the outer circumferential surface of the protector and the inner circumferential surface of the fluid-guiding sleeve; the fluid outlet is formed at the core portion of the upper connector; the first annular cavity, the second annular cavity, the third annular cavity, the fourth annular cavity, and the fluid outlet are connected orderly to a well fluid pipe; the electric conducting system comprises a motor lead wire, a center hole of the protector, a fifth annular cavity, and a wire outlet; the center hole of the protector is formed at the core portion of the protector; the fifth annular cavity is formed above the core of the protector; the wire outlet is formed at the core of the upper connector; the center hole of the protector and the fifth annular cavity are connected orderly to the wire outlet; and one end of the motor lead wire is led out of an inner cavity of the motor, the other end of the motor lead wire is entered into the fifth annular cavity by passing through the center hole of the protector and is coiled in multiple turns therein, and then is led out through the wire outlet at the core of the upper connector.

In a class of this embodiment or in another embodiment, the upper connector is set up an upper end of the suspended electric submersible PCP; the fluid outlet and the wire outlet are through holes running in a vertical direction, are separated from each other, and are formed at the core of the upper connector; an upper end of the fluid outlet is connected with a bottom end of the well fluid pipe; a lower end of the fluid outlet is connected with the fourth annular cavity; an upper end of the wire outlet is connected with a cable joint; a lower end of the wire outlet is connected with the fifth annular cavity above the protector; and a lower end of the upper connector is connected with the fluid-guiding sleeve and an upper end of a shell of the protector.

In another class of this embodiment or in another embodiment, the core portion of the protector is formed with a center hole hermetically separated from an inner cavity of the protector; an upper end of the center hole is formed with the fifth annular cavity; a lower end of the center hole is connected with an upper end of the motor inner cavity of the driving mechanism; the fourth annular cavity is formed between the outer circumferential surface of the protector and an inner wall of the fluid-guiding sleeve (4); and a lower end of a shell of the protector is connected with an upper end of a shell of the driving mechanism.

In another class of this embodiment or in another embodiment the driving mechanism is set up inside the fluid-guiding sleeve; an upper end of a shell of the driving mechanism is connected with a lower end of a shell of the protector; and the third annular cavity is formed between an inner wall of the fluid-guiding sleeve and the outer circumferential surface of the driving mechanism.

In another class of this embodiment or in another embodiment, the fluid-guiding sleeve is in a shape of a cylinder; an upper end of the fluid-guiding sleeve is connected with a lower end of the upper connector; and the fluid-guiding sleeve hermetically separates the fourth annular cavity and the third annular cavity from external environment.

In another class of this embodiment or in another embodiment, an upper end of the outer sleeve is connected with a lower end of the fluid-guiding sleeve; a lower end of the outer sleeve is connected with an upper end of a shell of the PCP; the second annular cavity is formed between the inner circumferential surface of the outer sleeve and the outer circumferential surface of the flexible shaft; the outer sleeve serves to hermetically separate the second annular cavity from external environment; an upper end of the flexible shaft is connected with an output shaft of the driving mechanism; a lower end of the flexible shaft is connected with an upper end of the rotor of the PCP; and the first annular cavity is formed between the outer circumferential surface of the bearing shell and the inner circumferential surface of the outer sleeve.

In another class of this embodiment or in another embodiment, the bearing shell at the lower journal of the flexible shaft and the outer sleeve relative to the bearing shell position forms a plain bearing; and the difference between the outer diameter of the bearing shell and the inner diameter of the outer sleeve relative to the bearing shell position is proportional to the eccentricity E of the PCP.

In another class of this embodiment or in another embodiment, any or all of the connections between elements are direct.

As a result, the invention has the advantages of simple structure and low manufacturing cost, and is easy to assemble and maintain. More importantly, the invention allows the suspended electric submersible PCP to be operated reliably when the well fluid contains high sand content, the slope of the well is sharp, the suspended position of pump is low, the pipe contains many inflexion points, etc.

BRIEF DESCRIPTION OF THE DRAWINGS

The invention is described hereinbelow with reference to accompanying drawings, in which.

The reference numbers of the various parts shown in above drawings are listed below, in which well fluid pipe corresponds to the number 1; cable joint —2; upper connector —3; fluid outlet —3*a*; wire outlet —3*b*; fluid-guiding sleeve —4; fourth annular cavity—5; protector —6; fifth annular cavity —6*a*; inner cavity of the protector —6*b*; center hole —6*c*; driving mechanism —7; inner cavity of the motor —7*a*; lead wire of the motor—7*b*; third annular cavity —8; shaft coupling —9; outer sleeve —9*a*; flexible shaft —9*b*; second annular cavity —9*c*; bearing shell —9*d*; first annular cavity —9*e*; and PCP —10.

DETAILED DESCRIPTION OF THE EMBODIMENTS

The fluid-guiding and electric conducting system for a suspended electric submersible PCP of the invention will hereinafter be described further with reference to the drawings.

Figure 1:
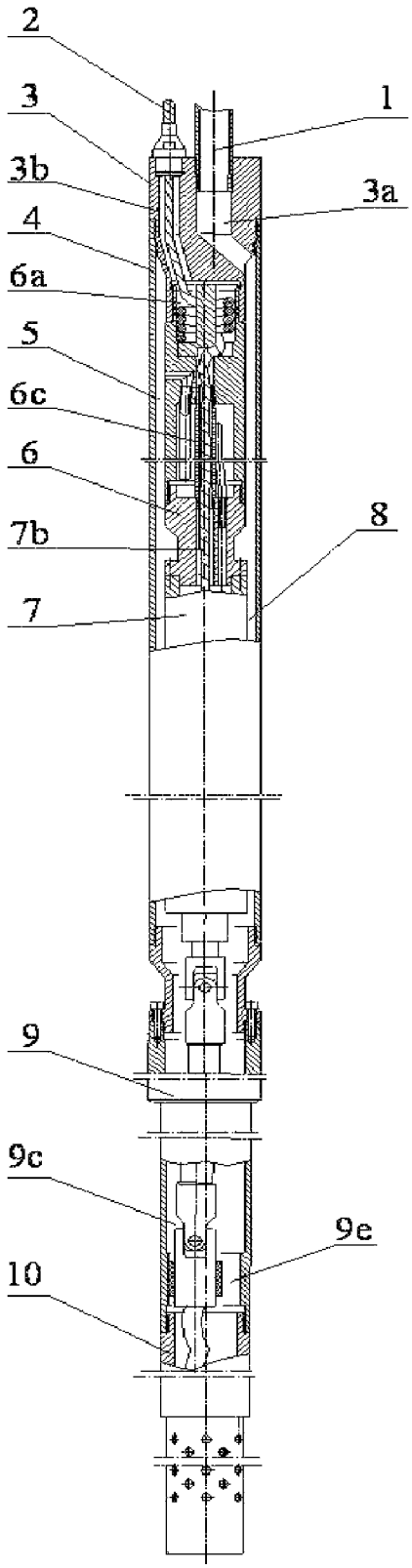
FIG. 1 illustrates a longitudinal cross-sectional view of a suspended electric submersible PCP with a fluid-guiding and electric conducting system in accordance with one embodiment of the invention.
Figure 2:
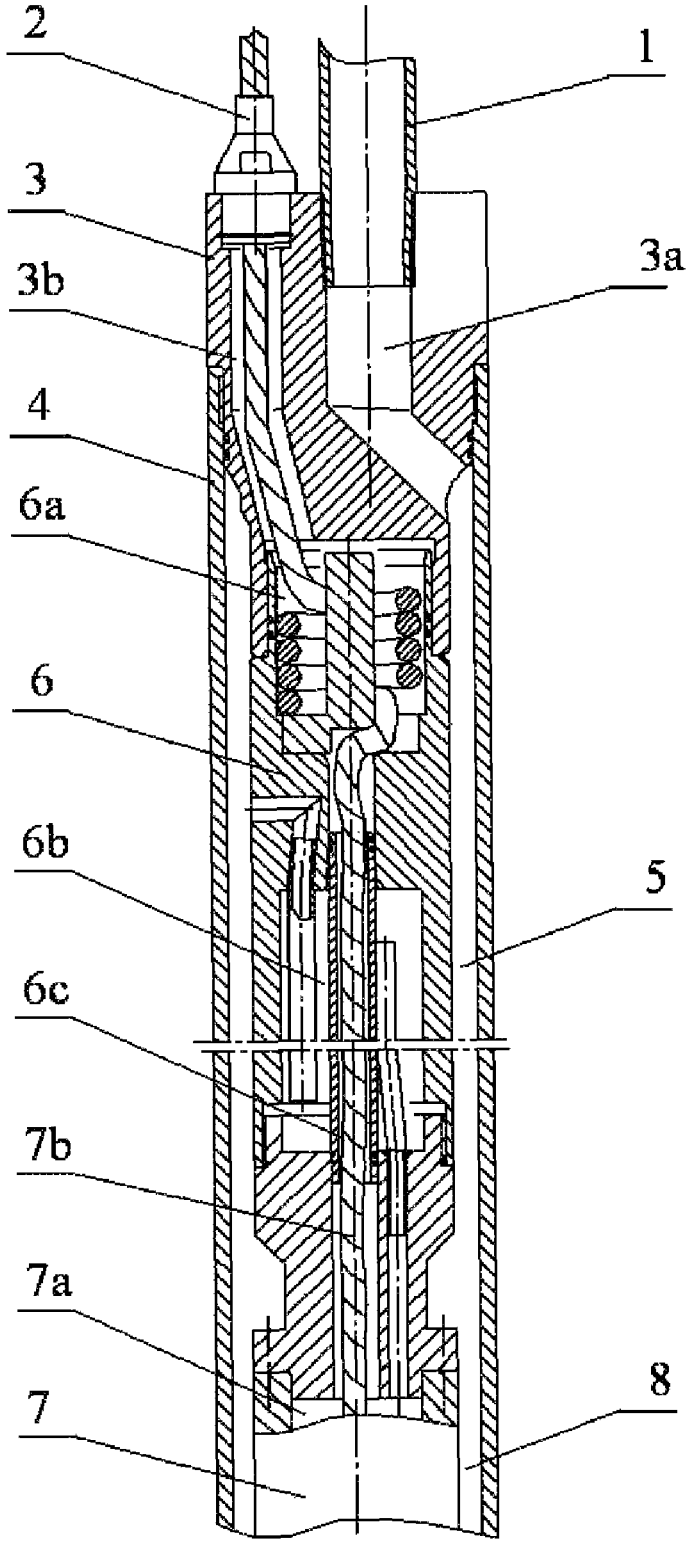
FIG. 2 illustrates a longitudinal cross-sectional view of an upper connector and a protector of a suspended electric submersible PCP with a fluid-guiding and electric conducting system in accordance with one embodiment of the invention.
Figure 3:
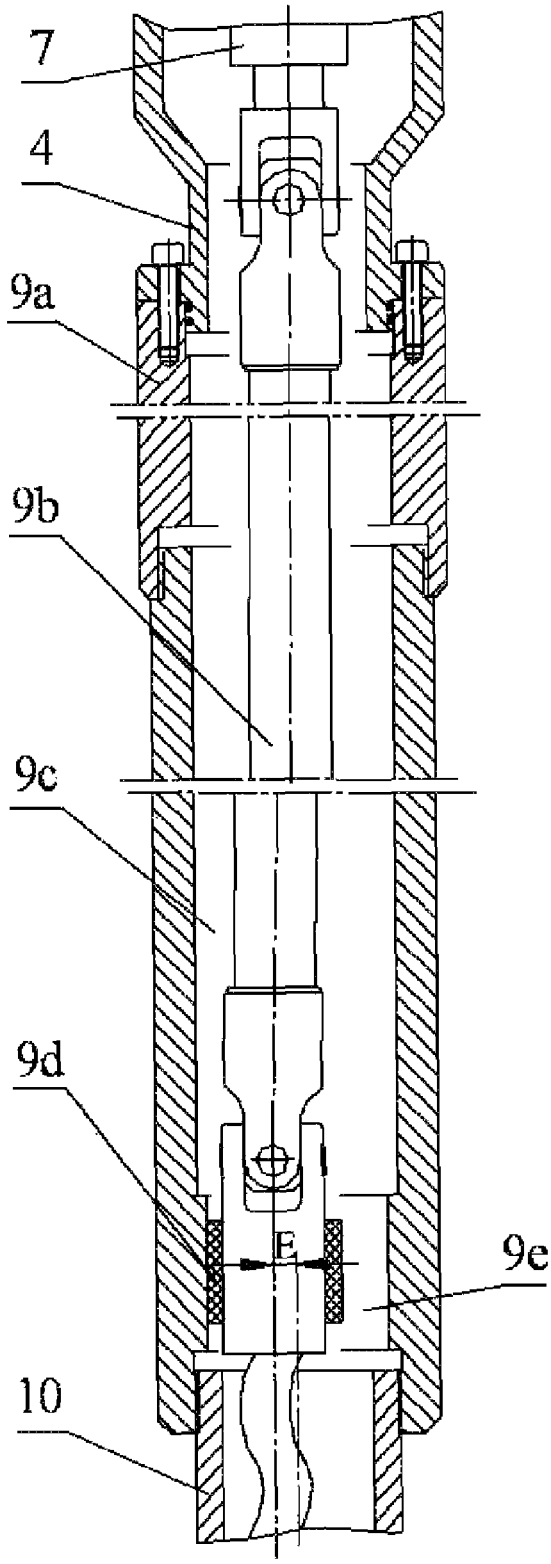
FIG. 3 illustrates a longitudinal cross-sectional view of a shaft coupling of a suspended electric submersible PCP with a fluid-guiding and electric conducting system in accordance with one embodiment of the invention.

As shown in FIGS. 1-3, the fluid-guiding and electric conducting system for a suspended electric submersible PCP of the invention comprises a fluid-guiding system and an electric conducting system. The fluid-guiding system comprises an upper connector 3, a protector 6, a fluid-guiding sleeve 4, a driving mechanism 7, a shaft coupling 9, a first annular cavity 9*e*, a second annular cavity 9*c*, a third annular cavity 8, a fourth annular cavity 5, and a fluid outlet 3*a*. The electric conducting system comprises a motor cable lead wire 7*b*, a center hole 6*c* of the protector 6, a fifth annular cavity 6*a*, and a wire outlet 3*b*.

The upper connector 3 is located at the upper portion of the suspended electric submersible PCP. The fluid outlet 3*a* and the wire outlet 3*b* are disposed at the core portion of the upper connector 3. The fluid outlet 3*a* and wire outlet 3*b* are through holes running in the vertical direction and are separated from each other. The upper end of the fluid outlet 3*a* is connected with the lower end of the well fluid pipe 1. The lower end of the fluid outlet 3*a* is connected with the fourth annular cavity 5 located between the inner wall of the fluid-guiding sleeve 4 and the outer circumferential surface of the protector 6. The upper end of the wire outlet 3*b* is connected with the cable joint 2. The lower end of the wire outlet 3*b* is connected with the fifth annular cavity 6*a* above the protector. The lower end of the upper connector 3 is connected tightly with the fluid-guiding sleeve 4 and the upper end of the shell of the protector 6.

The core portion of the protector 6 is formed with a center through hole 6*c* hermetically separated from the inner cavity of the protector. The upper end of the through hole 6*c* is formed with the fifth annular cavity 6*a*. The lower end of the through hole 6*c* is connected with the upper end of the motor inner cavity 7*a* of the driving mechanism 7. The fourth annular cavity 5 is formed between the outer circumferential surface of the protector 6 and the inner wall of the fluid-guiding sleeve 4; the lower end of the shell of the protector 6 is connected tightly with the upper end of the shell of the driving mechanism 7.

The driving mechanism 7 is located inside of the fluid-guiding sleeve 4. The upper end of the shell of the driving mechanism is connected tightly with the lower end of the shell of the protector 6. The third annular cavity 8 is formed between the inner wall of the fluid-guiding sleeve 4 and the outer circumferential surface of the driving mechanism 7.

The fluid-guiding sleeve 4 is in a shape of cylinder. The upper end of the fluid-guiding sleeve 4 is connected tightly with the lower end of the upper connector 3. The fluid-guiding sleeve 4 serves to hermetically separate the fourth annual cavity 5 and the third annular cavity 8 from external environment.

The shaft coupling 9 comprises an outer sleeve 9*a*, a flexible shaft 9*b*, and a bearing shell 9*d*. The upper end of the outer sleeve 9*a* is connected tightly with the lower end of the fluid-guiding sleeve 4. The lower end of the outer sleeve 9*a* is connected tightly with the upper end of the shell of the PCP 10. The second annular cavity 9*c* is formed between the inner circumferential surface of the outer sleeve 9*a* and the outer circumferential surface of the flexible shaft 9*b*. The outer sleeve 9*a* serves to hermetically separate the second annular cavity 9*c* from external environment. The upper end of the flexible shaft 9*b* is connected with the output shaft of the driving mechanism 7. The lower end of the flexible shaft 9*b* is connected with the upper end of the rotator of the PCP 10. The bearing shell 9*d* at the lower journal of the flexible shaft 9*b* and the outer sleeve 9*a* relative to the bearing shell 9*d* position forms a plain bearing; and the difference between the outer diameter of the bearing shell 9*d* and the inner diameter of the outer sleeve 9*a* relative to the bearing shell 9*d* position is proportional to the eccentricity E of the PCP 10. The first annular cavity 9*e* is formed between the outer circumferential surface of the bearing shell 9*d* and the inner circumferential surface of the outer sleeve 9*a*.

The connection of the electric conducting system for the suspended electric submersible PCP of the invention will hereinafter be described briefly. As shown in FIGS. 1-3, the center hole 6*c* of the protector 6 and the fifth annular cavity 6*a* are connected orderly to the wire outlet 3*b*. One end of the motor lead wire 7*b* is led out from the inner cavity 7*a* of the motor. The other end of the motor lead wire 7*b* enters into the fifth annular cavity 6*a* by passing through the center hole 6*c* of the protector 6, is coiled in multiple turns therein, and then is led through the wire outlet 3*b* at the core of the upper connector for connecting with the cable joint 2.

The operation process of the A fluid-guiding and electric conducting system for the suspended electric submersible PCP of the invention will hereinafter be described. After power is connected to the driving mechanism 7 via the motor lead wire 7*b* by means of the cable joint 2, the well fluid is lifted and passes through the first annular cavity 9*e*, the second annular cavity 9*c*, the third annular cavity 8, the fourth annular cavity 5, and the fluid outlet 3*a* of the upper connector 3 in the fluid-guiding system, and flows into the well fluid pipe 1.

This invention is not to be limited to the specific embodiments disclosed herein and modifications for various applications and other embodiments are intended to be included within the scope of the appended claims. While this invention has been described in connection with particular examples thereof, the true scope of the invention should not be so limited since other modifications will become apparent to the skilled practitioner upon a study of the drawings, specification, and following claims.

What is claimed is:

1. A fluid-guiding and electric conducting system for a suspended electric submersible PCP, comprising a fluid-guiding system and an electric conducting system, wherein said fluid-guiding system comprises an upper connector (3) having a core portion, a protector (6) having an outer circumferential surface, a fluid-guiding sleeve (4) having an inner circumferential surface, a driving mechanism (7) having an outer circumferential surface, a shaft coupling (9), a first annular cavity (9*e*), a second annular cavity (9*c*), a third annular cavity (8), a fourth annular cavity (5), and a fluid outlet (3*a*);

said shaft coupling (9) comprises a bearing shell (9*d*) having an outer circumferential surface, an outer sleeve (9*a*) having an inner circumferential surface, and a flexible shaft (9*b*) having an outer circumferential surface;

said first annular cavity (9*e*) is formed between the outer circumferential surface of the bearing shell (9*d*) of the shaft coupling (9) and the inner circumferential surface of the outer sleeve (9*a*) of the shaft coupling (9);

said second annular cavity (9*c*) is formed between the inner circumferential surface of the outer sleeve (9*a*) of the shaft coupling (9) and the outer circumferential surface of the flexible shaft (9*b*);

said third annular cavity (8) is formed between the inner circumferential surface of the fluid-guiding sleeve (4) and the outer circumferential surface of the driving mechanism (7);

said fourth annular cavity (5) is formed between the outer circumferential surface of the protector (6) and the inner circumferential surface of the fluid-guiding sleeve (4);

said fluid outlet (3*a*) is formed at the core portion of the upper connector (3);

said first annular cavity (9*e*), said second annular cavity (9*c*), said third annular cavity (8), said fourth annular cavity (5), and said fluid outlet (3*a*) are connected orderly to a well fluid pipe (1);

said electric conducting system comprises a motor lead wire (7*b*), a center hole (6*c*) of the protector (6), a fifth annular cavity (6*a*), and a wire outlet (3*b*);

said center hole (6*c*) of said protector (6) is formed at the core portion of the protector (6);

said fifth annular cavity (6*a*) is formed above the core of the protector (6);

said wire outlet (3*b*) is formed at the core of the upper connector (3);

said center hole (6*c*) of the protector (6) and the fifth annular cavity (6*a*) are connected orderly to the wire outlet (3*b*); and one end of said motor lead wire (7*b*) is led out of an inner cavity (7*a*) of the motor, the other end of said motor lead wire (7*b*) is entered into the fifth annular cavity (6*a*) by passing through the center hole (6*c*) of the protector (6) and is coiled in multiple turns therein, and then is led out through the wire outlet (3*b*) at the core of the upper connector (3).

2. The system of claim 1, wherein said upper connector (3) is set up at an upper end of the suspended electric submersible PCP;

said fluid outlet (3*a*) and said wire outlet (3*b*) are through holes running in a vertical direction, are separated from each other, and are formed at said core of said upper connector;

an upper end of said fluid outlet (3*a*) is connected with a bottom end of the well fluid pipe (1);

a lower end of said fluid outlet (3*a*) is connected with the fourth annular cavity (5);

an upper end of said wire outlet (3*b*) is connected with a cable joint (2);

a lower end of said wire outlet (3*b*) is connected tightly with said fifth annular cavity (6*a*) above the protector (6); and a lower end of said upper connector (3) is connected with the fluid-guiding sleeve (4) and an upper end of a shell of said protector (6).

3. The system of claim 1, wherein said core portion of said protector (6) is formed with a center hole (6*c*) hermetically separated from an inner cavity of said protector (6);

an upper end of said center hole (6*c*) is formed with said fifth annular cavity (6*a*);

a lower end of said center hole (6*c*) is connected with an upper end of said motor inner cavity (7*a*) of said driving mechanism (7);

said fourth annular cavity (5) is formed between said outer circumferential surface of said protector (6) and an inner wall of said fluid-guiding sleeve (4); and a lower end of a shell of said protector (6) is connected tightly with an upper end of a shell of said driving mechanism (7).

4. The system of claim 1, wherein said driving mechanism (7) is established inside said fluid-guiding sleeve (4);

an upper end of a shell of said driving mechanism is connected with a lower end of a shell of said protector (6); and said third annular cavity (8) is formed between an inner wall of said fluid-guiding sleeve (4) and said outer circumferential surface of said driving mechanism (7).

5. The system for claim 1, wherein said fluid-guiding sleeve (4) is in a shape of a cylinder;

an upper end of said fluid-guiding sleeve is connected tightly with a lower end of the upper connector (3); and said fluid guiding sleeve (4) hermetically separates said fourth annular cavity (5) and said third annular cavity (8) from external environment.

6. The system of claim 1, wherein an upper end of said outer sleeve (9*a*) is connected tightly with a lower end of said fluid-guiding sleeve (4);

a lower end of said outer sleeve (9*a*) is connected tightly with an upper end of a shell of the PCP (10);

the second annular cavity (9*c*) is formed between said inner circumferential surface of said outer sleeve (9*a*) and said outer circumferential surface of the flexible shaft (9*b*);

said outer sleeve (9*a*) serves to hermetically separate said second annular cavity (9*c*) from external environment;

an upper end of said flexible shaft (9*b*) is connected with an output shaft of said driving mechanism (7);

a lower end of said flexible shaft (9*b*) is connected with an upper end of the rotor of the PCP (10); and said first annular cavity (9*e*) is formed between said outer circumferential surface of said bearing shell (9*d*) and said inner circumferential surface of the outer sleeve (9*a*).

7. The system of claim 1, wherein the bearing shell (9*d*) at the lower journal of the flexible shaft (9*b*) and the outer sleeve (9*a*) relative to the bearing shell (9*d*) position forms a plain bearing; and the difference between the outer diameter of the bearing shell (9*d*) and the inner diameter of the outer sleeve (9*a*) relative to the bearing shell (9*d*) position is proportional to the eccentricity E of the PCP (10).

* * * * *